US005249592A

United States Patent [19]

Springer et al.

[11] Patent Number: 5,249,592

[45] Date of Patent: Oct. 5, 1993

[54] SELF-ERECTING TENT

[76] Inventors: Catherine P. Springer, 7 Lewis St., Apt. 1, Somerville, Mass. 02143; Edward L. Springer, 3811 Birch Ave., Madison, Wis. 53711

[21] Appl. No.: 805,267

[22] Filed: Dec. 10, 1991

[51] Int. Cl.[5] ..... E04H 15/40

[52] U.S. Cl. ..... 135/104; 135/106; 135/109; 135/905

[58] Field of Search ..... 135/104, 106, 115, 117, 135/109, 905

[56] References Cited

U.S. PATENT DOCUMENTS

| | | | |
|---|---|---|---|
| 1,775,145 | 9/1930 | Tennant et al. . | |
| 2,142,851 | 1/1939 | Jolly . | |
| 2,159,309 | 5/1939 | Betourne . | |
| 3,190,300 | 6/1965 | Wear'n . | |
| 3,675,667 | 7/1972 | Miller . | |
| 3,960,161 | 6/1976 | Norman . | |
| 3,990,463 | 11/1976 | Norman . | |
| 4,140,141 | 2/1979 | Marks | 135/109 X |
| 4,224,754 | 9/1980 | Derryberry . | |
| 4,237,914 | 12/1980 | Gantz | 135/109 X |
| 4,590,956 | 5/1986 | Griesenbeck | 135/104 X |
| 4,646,770 | 3/1987 | Lobato | 135/104 X |
| 4,825,892 | 5/1989 | Norman . | |
| 4,858,634 | 8/1989 | McLeese . | |
| 5,038,812 | 8/1991 | Norman . | |
| 5,137,044 | 8/1992 | Brady | 135/104 |

*Primary Examiner*—Carl D. Friedman
*Assistant Examiner*—Lan M. Mai
*Attorney, Agent, or Firm*—Quarles & Brady

[57] ABSTRACT

A portable self-erecting tent structure makes use of a pair of flexible, coilable, resilient bands, such as spring steel bands, to form the frame of the tent. One band can be folded to nest into the other and the two nested bands can be twisted until they assume a coiled, but stable, configuration for storage or transport. The tent is self-erecting since disturbing the coiled configuration of the bands causes them to uncoil, and the resilience of the bands and the springs connecting them then causes the frame of the tent to erect itself.

2 Claims, 4 Drawing Sheets

SELF-ERECTING TENT

FIELD OF THE INVENTION

The present invention relates to tents or portable shelters in general and relates, in particular, to tents portable shelters which are capable of erecting themselves.

BACKGROUND OF THE INVENTION

Portable shelters such as tents are common means of shelter widely used by human beings. In industrialized countries, such structures are typically associated with recreation, although they may often be used for temporary shelter from the elements. Historically, one of the principal difficulties or drawbacks associated with the use of portable structures or tents have been problems associated with erecting the structures in place. Most frames or supports for tents include a large number of individual pieces, which can be lost, or which may require substantial amount of time or skill in order to assemble into the erect tent structure. Sometimes the erection of a portable structure can be a complex task which may require more than one person.

There have been structures proposed before for tents which might be described as self-erecting. In such structures, a pre-stressed band of material forms the framework for the tent. The material or band can be deformed into another stable shape in which it can be compactly stored. Generally the erection of such a structure involves deforming the structural material so that it will resiliently assume the shape associated with the erected tent.

U.S. Pat. No. 3,675,667 to Miller describes a self-erecting tent in which a resilient support member forms the entire perimeter of the tent, and the resilient support member can be folded into a coiled configuration so that the tent can be compactly stored.

A Mr. Norman patented several variations on portable tents, or other structures, which similarly used a continuous loop of flexible coiled resilient material as the structural member of the tent. In U.S. Pat. No. 3,960,161, a continuously but flexible flat spring steel stock is used in a saddle-like configuration to form the top and sides of the tent, and which may be coiled upon itself to compress the tent into a compact configuration. In U.S. Pat. No. 3,990,463, a similar flexible loop of resilient material is used for the structure of the tent, with the material being formed in the shape of a figure eight, with each loop of the figure eight forming one side of the tent. A related structure utilizing a figure eight design by the same Mr. Norman is disclosed in U.S. Pat. No. 4,825,892. U.S. Pat. No. 5,038,812 describes a self-erecting structure with a series of side members which may be coiled, and which may self-erect into a self-supporting structure.

SUMMARY OF THE INVENTION

The present invention is summarized in that a self-erecting shelter includes a structural frame made of a pair of oval shaped bands of flexible resilient material, the oval bands being joined along one side thereof, such that the oval bands form the bottom and one side of the tent, and with the joined section of the two loops forming a lower side edge of the tent, and further including first and second panels of material co-extensive with the oval bands and forming the bottom and one side of the tent, a removable section of material forming the other side of the tent and the door thereto, and end sheets of material closing the ends of the tent as formed by the frame.

It is an object of the present invention to provide an advantageous, convenient, and efficient self-erecting portable tent or shelter.

It is another object of the present invention to provide a self-erecting structure which is convenient and efficient both to manufacture and to use.

Other objects, advantages, and features of the present invention will become apparent from the following specification.

BRIEF DESCRIPTION OF THE PREFERRED EMBODIMENT

Figure 1:
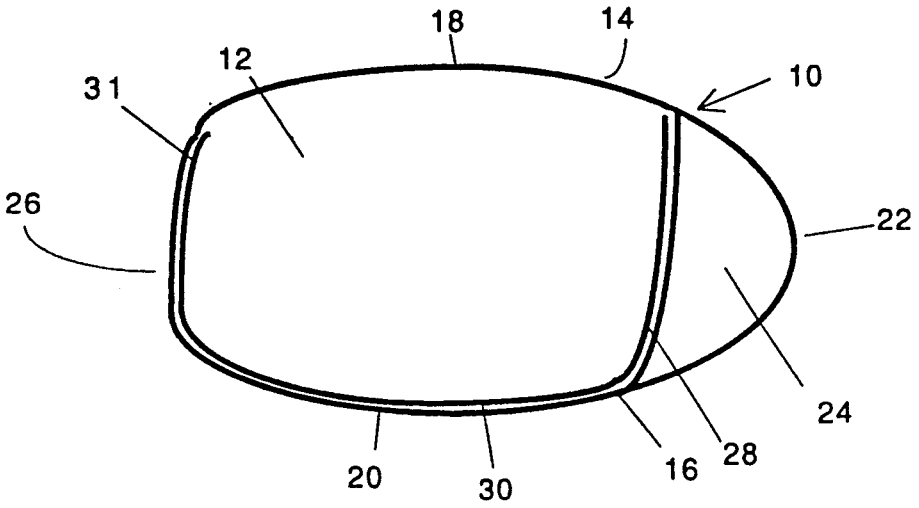
FIG. 1 is a side perspective view of a self-erecting tent structure constructed in accordance with the present invention.

Illustrated in FIG. 1, and generally indicated at 10, is a self-erecting structure in the form of a tent, constructed in accordance with the present invention. The tent 10 is, in this embodiment, generally in the shape of a conventional camping tent. In its end view, the tent would appear to be generally triangular with a pair of sides 12 and 14 and a base 16. The two sides 12 and 14 are canted inwardly at acute angles relative to the base and join at a common peak 18. At the lower two apexes of the triangle, bottom edges 20 and 22 of the base 16 join the bottom edges of the sides 12 and 14 respectively. A pair of generally triangular end flaps 24 and 26 close the ends of the tent and are each joined to both of the sides 12 and 14, as well as the base 16. The outer covering of the tent is composed of a fabric of sheet material, such as rip-stop nylon or other flexible, durable, and convenient sheet material normally used for a tent or shelter use. The side 12 forms the entrance and exit to the tent 10. A series of three separation lines 28, 30, and 31 define an opening which is closed by suitable recloseable fasteners, such as zippers. Opening the separation lines 28, 30, and 31 allows the flap of the side 12 of the tent to be drawn back, so that an opening is provided for entrance and exit from the interior of the tent 10. With the fasteners on all three lines 28, 30, and 31 opened, the side 12 of the tent can simply be rolled up and fastened at the peak 18, so that the tent can be used as a convenient sun shelter.

Figure 2:
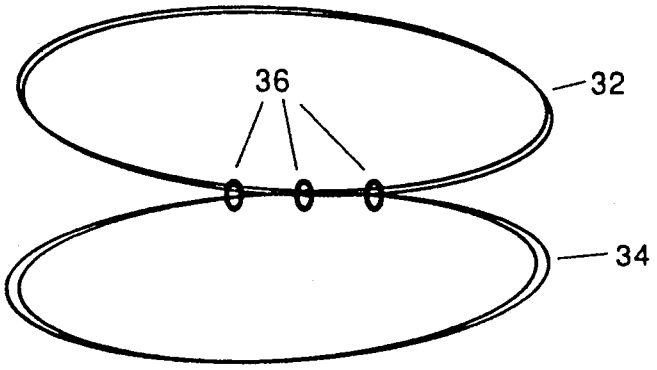
FIG. 2 is a perspective view of the frame for the tent structure of FIG. 1.

Shown in FIG. 2 is the internal frame which supports the tent 10. Essentially the internal structure consists of a frame formed by two oval bands 32 and 34. The oval bands 32 and 34 are formed of a resilient yet flexible material, such as spring steel stock. The oval band 34 in the base 16 is just slightly larger in overall circumference than the oval band 32 in the side 14. Along one of their longer sides, the oval bands 32 and 34 are joined together by a plurality of three spring connectors, each indicated at 36. Each of the spring connectors 36 consists of a coil spring which surrounds a co-extensive portion of each of the oval bands 32 and 34. For each of the coil springs 36, one end of the coil spring is attached, by welding or other suitable fixing, to the oval band 32 while the other end is similarly welded to the oval band 34. The ends of the spring connectors 36 are attached to the oval bands 32 and 34 so as to provide a spring bias to those bands, to urge them resiliently toward a preselected configuration. The configuration into which the bands are biased is the one viewed in FIG. 2. In that configuration, the oval band 34 serves as a base, and the oval band 32 is angled upward at an acute angle relative to the oval band 34. When these bands are inside of the tent 10, the oval band 32 supports the side 14 of the tent in its upward position. The base 16 of the tent is secured around its periphery to the oval band 34. Therefore, the oval band 32 supporting the side 14 of the tent also provides the structure by which the side 12 of the tent is stretched. The side 12 is stretched between the sides of the oval bands 32 and 34 which are opposite from the points of connection provided by the spring connectors 36.

Figure 3:
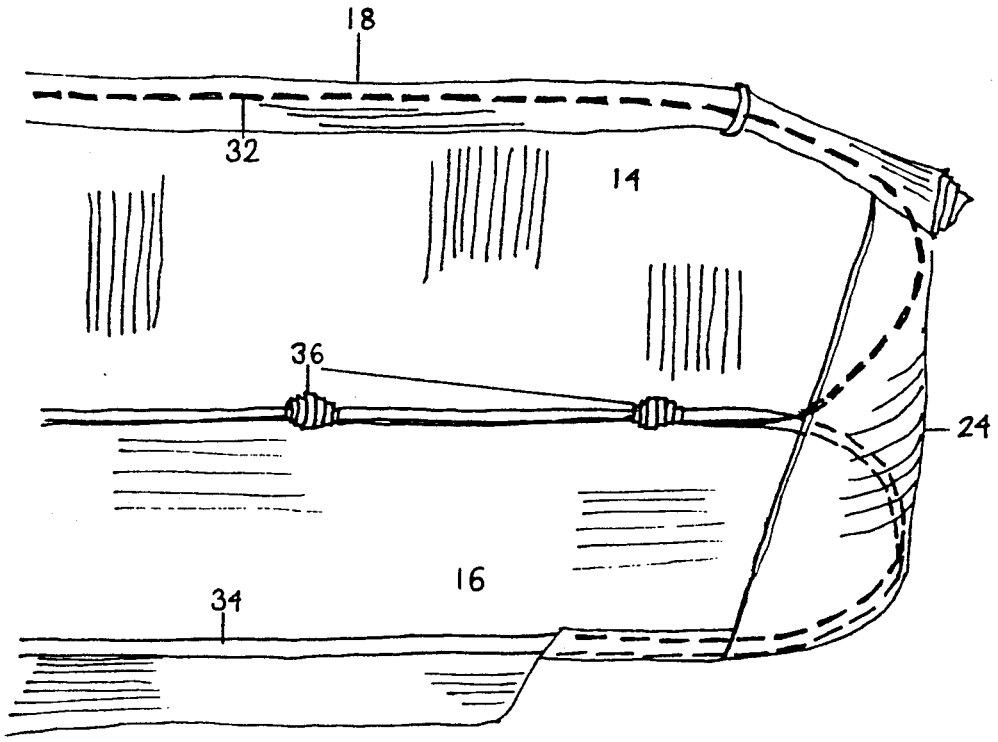
FIG. 3 is an elevational view of the interior tent of FIG. 1 opened.

As can be seen in FIG. 3, if the separation lines 28, 30, and 31 are opened, and the flap forming the side 12 of the tent is rolled back, the interior structure of the tent, including the two oval bands, can readily be viewed. It is also possible, and in fact preferred, that suitable additional flaps of fabric be provided on the inside of the tent 10 so as to cover entirely the oval bands 32 and 34, and the spring connectors 36, so that they cannot be contacted by anyone occupying the tent 10.

Figure 4A:
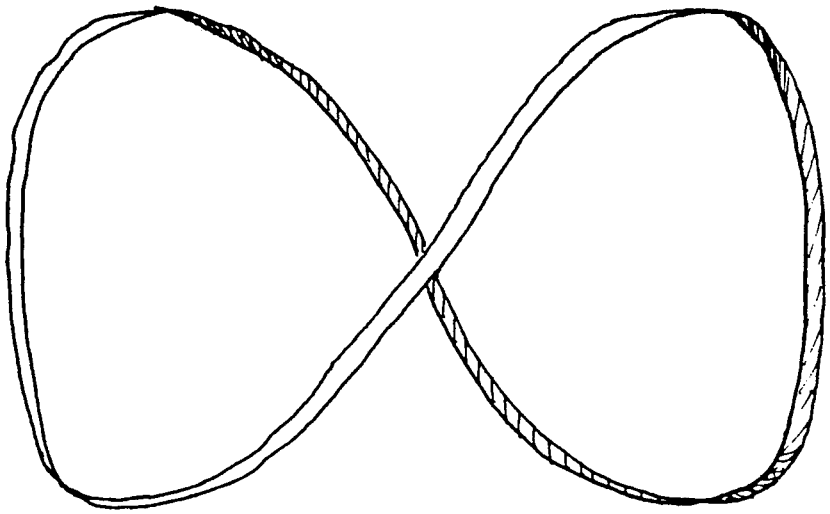
FIG. 4A, B and C illustrate the general concept of collapsing the frame of the self-erecting structure of FIG. 1.
Figure 4B:
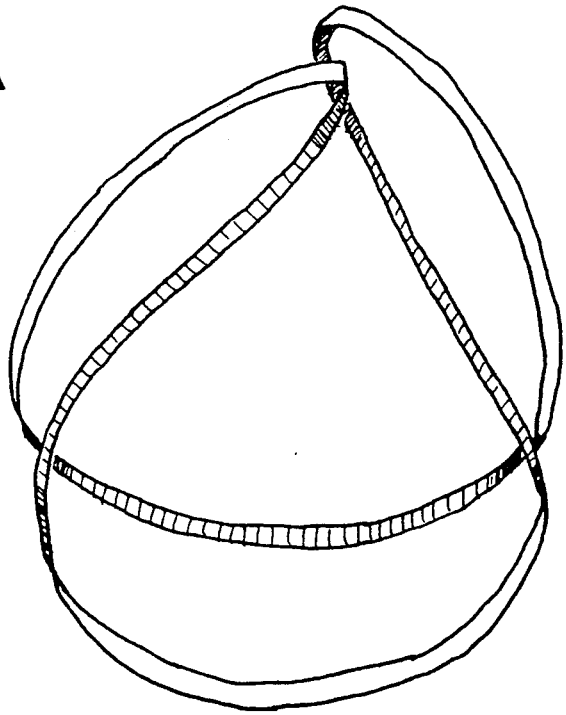
Figure 4C:
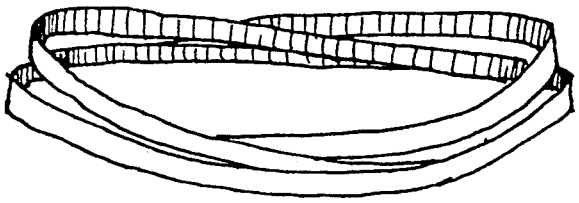
Figure 5:
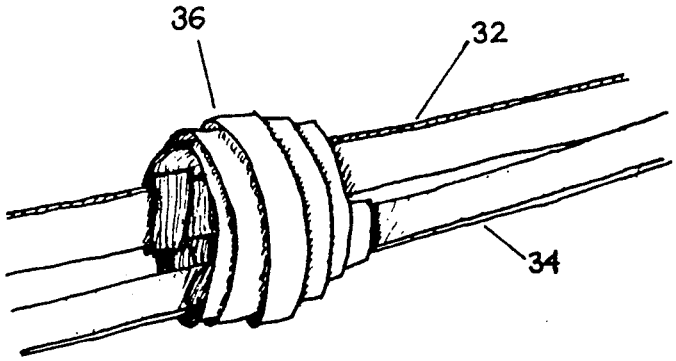
FIG. 5 is a perspective view of a coil spring of the structure illustrated in FIG. 3.

FIG. 4 is designed to illustrate graphically how the tent of FIG. 1 may readily and quickly be collapsed for storage. The oval bands 32 and 34 are preferably formed of a resilient material, such as a sheet of spring steel stock. Such spring steel stock will tend to resiliently urge itself back toward its resting position, which in the case of the bands 32 and 34 is in the shape of an oval. However, due to the topology of such an oval, there are other coiled states into which the band can be manipulated and which are also stable. As shown in FIG. 4, a band can be twisted until such time as the band coils upon itself exactly three times. In that configuration, all the twists in the band are eliminated, and such a band can assume a stable configuration in which it is coiled thrice upon itself. The result is a compact circular shape having one-third the circumference of the unfolded band. This coiled state is quite stable unless, and until, it is physically disrupted. Gross physical shock to the band in its coiled state, as shown in FIG. 4C, results in the band destabilizing and resuming its configuration in an oval shape.

This phenomenon is what allows the tent of FIGS. 1 to 3 to be easily collapsed and stored, and still be self-erecting. To collapse the tent of FIG. 1, the oval band 32 is brought downward, against the force of the spring connectors 36, until it resides inside of the oval band 34. The oval band 32 is made just smaller than the oval band 34 precisely to accommodate this objective. Once the oval band 32 is inside the oval band 34, the two bands may be modeled as a single band, such as shown in FIG. 4, for purposes of manipulating into a twisted state. The tent at this point is flat, with the fabric resting generally within the base 16 as defined by the oval band 34. The ends of the oval bands can then be twisted relative to each other, as shown with a single band in FIG. 4A, until the triply twisted configuration of FIG. 4C is achieved. As it happens, the fabric comprising the sides 12 and 14, the base 16, and the end flaps 24 and 26 of the tent 10 of FIG. 1 can readily be accommodated during this folding. The result is the tent collapsed into a flat compact configuration in which it can readily and conveniently be carried and stored. To secure the tent in this compact coiled configuration, a storage band can be placed around the coiled bands. Such a storage band can be one that is tightened in place or can be a stretched resilient loop such as a shock or bungee cord.

To erect the tent from its folded and stored configuration, all that is necessary is that the tent simply be thrown onto the ground. If the force with which the collapsed tent hits the ground is sufficient, the oval bands will be jostled from their stable triply coiled configuration as shown in FIG. 4C, and they will spontaneously return to their oval configuration as shown in FIG. 2. When the bands 32 and 34 do resume their oval configuration, the tent 10 of FIG. 1 is automatically erected. In other words, the tent is entirely self-erecting. While manipulating the tent to its collapsed configuration may require some manual manipulation of the tent itself, to erect the tent all that is necessary is that the collapsed tent be thrown to the ground or jostled mechanically in some other convenient fashion. The tent may require fixing to the site, but no further erection process at all is required to complete the structure of the tent.

It is readily envisioned that this structure because of its economy, efficiency and simplicity, can readily be adopted for other shelter purposes besides tents. It can be used for sun shelters, for umbrellas, for wind shelters, for play structures, or for any other convenient, light, and readily portable structure which is desired. Such variations can be accomplished merely by changing which sides of the structure are covered by suitable fabric or canvas covering.

It is envisioned that the present invention is subject to some variation and modification, but it is understood that the foregoing specification is illustrative only and that the present invention encompasses such modifications and variations thereof as will be compassed within the following claims.

We claim:

1. A collapsible and portable self-erecting structure comprising a frame comprising a pair of oval bands of resilient spring material, one of the oval bands being slightly smaller in circumference than the other;

a plurality of spring connectors joining together a portion of each of the oval bans, the spring connectors connected to resiliently bias the oval bands apart at an acute angle; and a covering of flexible sheet material arranged on the frame to provide shelter, such that the structure may be collapsed by nesting the two oval bands together one inside the other and then twisting the bands into a triply looped configuration;

the spring connectors being formed of flat spring steel stock coiled around the two bands with each end of the spring connector welded to a one of the oval bands so as to provide the spring bias between the bands.

2. A portable self-erecting tent structure having a base and first and second opposed sides, the structure comprising a frame formed from a pair of oval bands of spring steel material, one of the bands being slightly larger than the other so that the bands can nest one inside the other, the oval bands having first and second longer sides;

a plurality of spring connectors joining he bands together along their first longer sides, the spring connectors connected to each of the bands so as to bias the second longer sides of the bands apart, such that the bands are oriented at an acute angle relative to each other, with the larger band positioned in the base of the structure forming a floor of said tent structure and the smaller band positioned in the first side thereof; and a covering of flexible fabric encompassing the frame, the covering having formed therein a closable opening in the second side of the structure opposite from the first side to serve as a closable door of the tent structure;

the tent being collapsible by folding the band forming the first side into the band forming the base and then twisting the two bands simultaneously until they reach a triply coiled, stable configuration, the tent then being self-erecting by disturbing the stable configuration of the bands.

* * * * *